US011308880B2

(12) United States Patent
Kim et al.

(10) Patent No.: US 11,308,880 B2
(45) Date of Patent: Apr. 19, 2022

(54) LIGHT EMITTING DISPLAY DEVICE AND DRIVING METHOD THEREOF

(71) Applicant: LG Display Co., Ltd., Seoul (KR)

(72) Inventors: Jung-Jae Kim, Goyang-si (KR); Yong-Chul Kwon, Seoul (KR); Soon-Dong Cho, Gumi-si (KR); Sang-Uk Lee, Seoul (KR); Dongwon Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/127,337

(22) Filed: Dec. 18, 2020

(65) Prior Publication Data

US 2021/0201784 A1 Jul. 1, 2021

(30) Foreign Application Priority Data

Dec. 27, 2019 (KR) ..... 10-2019-0176983

(51) Int. Cl.

| | |
|---|---|
| ***G09G 3/3233*** | (2016.01) |
| ***G09G 3/3266*** | (2016.01) |
| ***G09G 3/20*** | (2006.01) |
| *G09G 3/3275* | (2016.01) |

(52) U.S. Cl.

CPC ..... *G09G 3/3233* (2013.01); *G09G 3/2003* (2013.01); *G09G 3/3266* (2013.01); *G09G 3/3275* (2013.01); *G09G 2310/0286* (2013.01); *G09G 2310/08* (2013.01); *G09G 2320/0233* (2013.01); *G09G 2320/045* (2013.01)

(58) Field of Classification Search

CPC .. G09G 3/3233; G09G 3/3266; G09G 3/2003; G09G 2320/045; G09G 3/3275; G09G 2310/08; G09G 2320/0233; G09G 2310/0286

See application file for complete search history.

(56) References Cited

U.S. PATENT DOCUMENTS

| | | | | |
|---|---|---|---|---|
| 8,169,163 | B2 * | 5/2012 | Kang | G09G 3/342 315/312 |
| 10,319,309 | B2 * | 6/2019 | Kim | G09G 3/3291 |
| 2010/0110059 | A1 * | 5/2010 | Kang | G09G 3/342 345/211 |
| 2010/0117937 | A1 | 5/2010 | Kim et al. | |
| 2013/0106676 | A1 * | 5/2013 | Ono | G09G 3/30 345/76 |

(Continued)

FOREIGN PATENT DOCUMENTS

| | | |
|---|---|---|
| KR | 10-2010-0053345 A | 5/2010 |
| KR | 10-2013-0101813 A | 9/2013 |

(Continued)

*Primary Examiner* — Jeff Piziali

(74) *Attorney, Agent, or Firm* — Morgan, Lewis & Bockius LLP

(57) ABSTRACT

A light emitting display device includes a display panel, a power supply configured to supply a first potential voltage and a second potential voltage to the display panel, and a switch circuit unit configured to sense the first potential voltage applied to the display panel and to feedback the first potential voltage to the power supply, wherein the power supply compensates for the first potential voltage based on the first potential voltage fed back from the switch circuit unit and to output the compensated first potential voltage.

13 Claims, 19 Drawing Sheets

(56) References Cited

U.S. PATENT DOCUMENTS

| | | | | |
|---|---|---|---|---|
| 2013/0229402 | A1* | 9/2013 | Park | G09G 3/3607 345/694 |
| 2013/0235010 | A1* | 9/2013 | Park | G09G 3/3291 345/209 |
| 2013/0241808 | A1* | 9/2013 | Kwon | H02M 3/158 345/76 |
| 2014/0232275 | A1* | 8/2014 | Kwon | G09G 3/3233 315/161 |
| 2014/0312799 | A1 | 10/2014 | Kim | |
| 2015/0155779 | A1* | 6/2015 | Kwon | G09G 3/3258 345/212 |
| 2015/0244267 | A1* | 8/2015 | Park | H02M 3/158 345/76 |
| 2016/0049111 | A1 | 2/2016 | Lee et al. | |
| 2016/0071468 | A1* | 3/2016 | Park | G09G 3/3607 345/694 |
| 2016/0086542 | A1* | 3/2016 | Lee | G09G 3/3225 345/212 |
| 2017/0032738 | A1* | 2/2017 | Lee | G09G 3/3233 |
| 2019/0066598 | A1 | 2/2019 | Kim et al. | |

FOREIGN PATENT DOCUMENTS

| | | | |
|---|---|---|---|
| KR | 10-2014-0124608 | A | 10/2014 |
| KR | 10-2016-0020035 | A | 2/2016 |
| KR | 10-2019-0024330 | A | 3/2019 |

* cited by examiner (a)

(b)

LIGHT EMITTING DISPLAY DEVICE AND DRIVING METHOD THEREOF

This application claims the benefit of Korean Patent Application No. 10-2019-0176983, filed on Dec. 27, 2019, which is hereby incorporated by reference as if fully set forth herein.

BACKGROUND

Technical Field

The present disclosure relates to a light emitting display device and a driving method thereof.

Discussion of the Related Art

With the development of information technologies, markets of display devices that are connection media between a user and information have expanded. Thus, display devices such as a light emitting display (LED), a quantum dot display (QDD), and a liquid crystal display (LCD) have been increasingly used.

The aforementioned display devices include a display panel including sub-pixels, a driver for outputting a driving signal for driving the display panel, and a power supply for generating power to be supplied to the display panel or the driver.

The aforementioned display device displays an image by enabling a selected sub-pixel to transmit light therethrough or to directly emit light when a driving signal, e.g., a scan signal and a data signal is supplied to sub-pixels formed on a display panel.

Among the aforementioned display devices, the LED has many advantages such as instrumental characteristics realized in a flexible form as well as electrical or optical characteristics such as a high response speed, high brightness, and a wide viewing angle.

SUMMARY

Accordingly, embodiments of the present disclosure are directed to a light emitting display device and a driving method thereof that substantially obviates one or more of the problems due to limitations and disadvantages of the related art.

According to the present disclosure, a deviation in IR drop at the positions of a sub-pixel, which occurs when the size of a display panel is increased in accordance with trends of large display devices, may be prevented and compensated for to achieve uniform brightness. In addition, according to the present disclosure, a deviation in IR drop of a high-brightness and high-current product range may be prevented and compensated for, thereby increasing the lifetime of a device as well as the driving stability of the device.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a light emitting display device comprises a display panel, a power supply configured to supply a first potential voltage and a second potential voltage to the display panel, and a switch circuit unit configured to sense the first potential voltage applied to the display panel and to feedback the first potential voltage to the power supply, wherein the power supply compensates for the first potential voltage based on the first potential voltage fed back from the switch circuit unit and to output the compensated first potential voltage.

The switch circuit unit may sense the first potential voltage applied every at least one scan line on the display panel and may feedback the first potential voltage to the power supply.

The switch circuit unit may be electrically connected to a shift register circuit unit configured to supply a scan signal to the display panel.

The switch circuit unit may include a plurality of switches positioned in a non-display area of the display panel.

The plurality of switches may be sequentially turned on in response to scan signals that are sequentially output from the shift register circuit unit.

The power supply may compensate for the first potential voltage in real time based on the first potential voltage feedback from the switch circuit unit and a reference voltage.

The first potential voltage may be compensated for at a high level away from a input point for the first potential voltage, disposed on the display panel.

The display panel may include a light emitting diode comprising a light-emitting layer in which at least two layers are stacked.

The light-emitting layer in which the at least two layers are stacked may emit light with the same color to represent one of pure colors or emits light with different colors to represent white.

In another aspect, a method of driving a light emitting display device comprises sensing a first potential voltage applied to a display panel and feeding back the first potential voltage to a power supply, and compensating for the first potential voltage to be applied to the display panel based on the fed back first potential voltage.

The compensating for the first potential voltage to be applied to the display panel may include compensating for the first potential voltage in real time based on the fed back first potential voltage and a reference voltage.

The first potential voltage may be compensated for at a high level away from a input point for the first potential voltage, disposed on the display panel.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

A light emitting display device according to the present disclosure may be embodied as a television, an image player, a personal computer (PC), a home theater, a smartphone, an electrical component of a vehicle, a flexible display, a wearable device, or the like. The light emitting display device may be embodied based on an inorganic light emitting diode or an organic light emitting diode. However, hereinafter, for convenience of description, the light emitting display device will be described in terms of an example in which the light emitting display device is embodied based on an organic light emitting diode.

Figure 1:
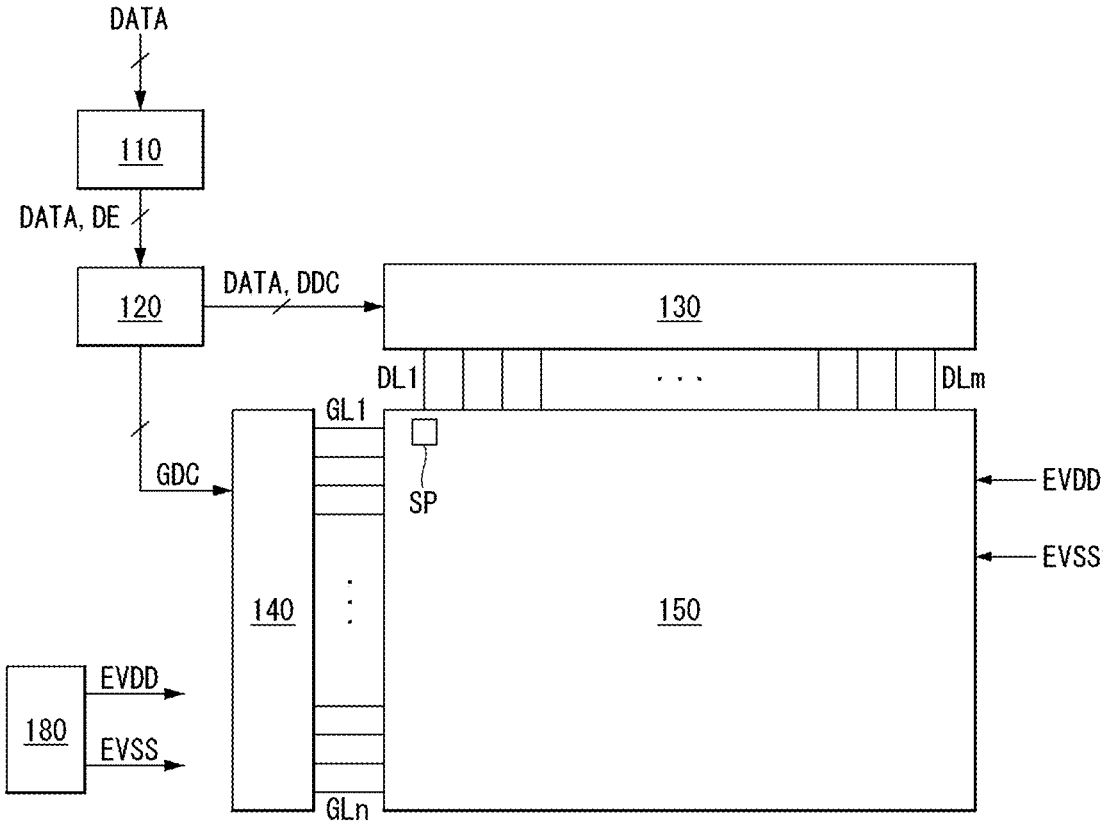
FIG. 1 is a schematic block diagram of a light emitting display device according to an embodiment of the present disclosure.
Figure 2:
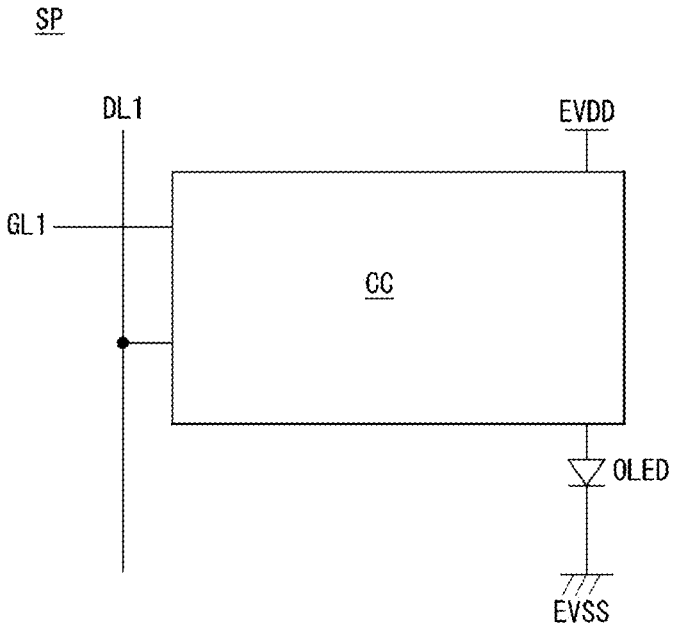
FIG. 2 is a schematic circuit diagram of the configuration of a sub-pixel.
Figure 3:
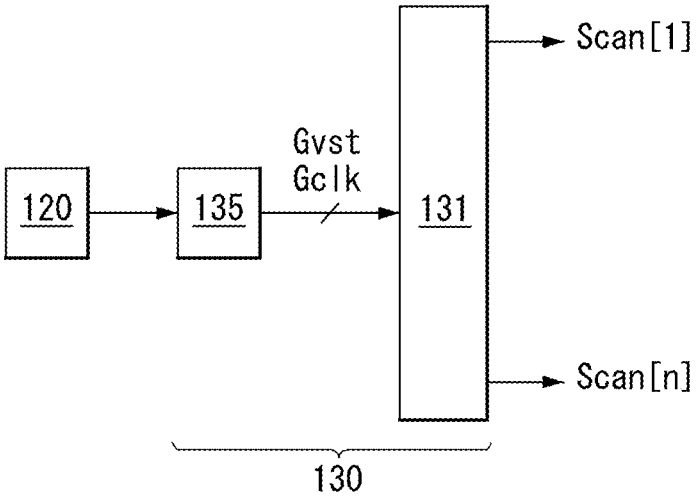
FIG. 3 is a diagram showing an example of the configuration of a device related to a scan driver using a gate in panel method.
Figure 4:
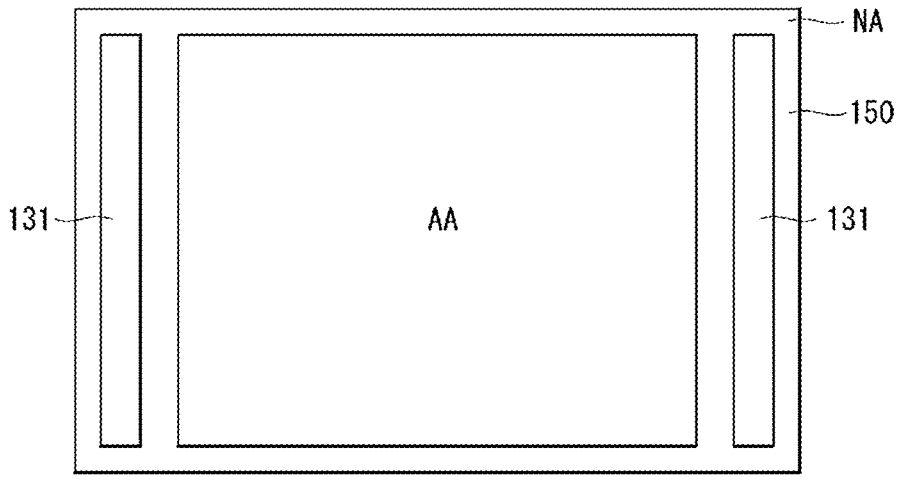
FIG. 4 is a diagram showing an example of arrangement of a shift register circuit unit.
Figure 4:
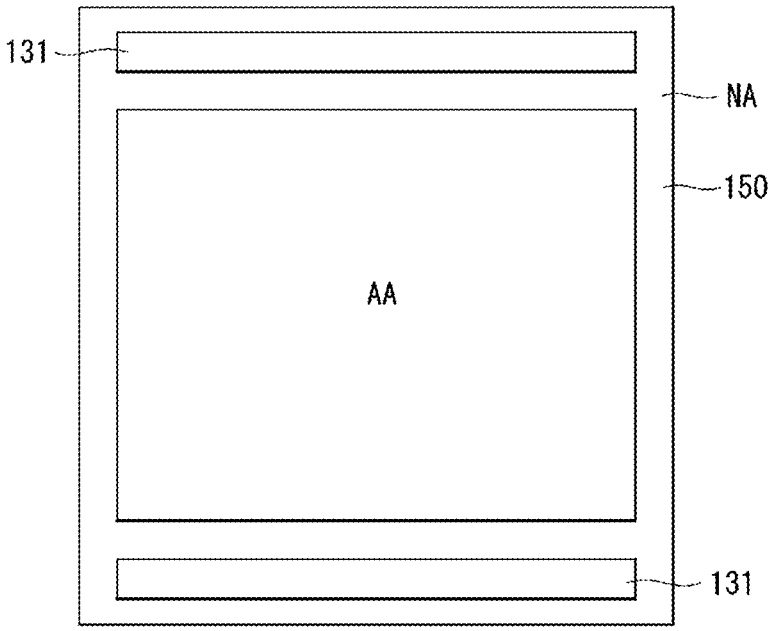

FIG. 1 is a schematic block diagram of a light emitting display device according to an embodiment of the present disclosure, FIG. 2 is a schematic circuit diagram of the configuration of a sub-pixel, FIG. 3 is a diagram showing an example of the configuration of a device related to a scan driver using a gate in panel method, and FIG. 4 is a diagram showing an example of arrangement of a shift register circuit unit.

As shown in FIG. 1, the light emitting display device according to an embodiment of the pre sent disclosure may include an image processor 110, a timing controller 120, a data driver 130, a scan driver 140, a power supply 180, and a display panel 150.

The image processor 110 may output a data enable signal DE or the like in addition to a data signal DATA supplied from the outside. The image processor 110 may output one or more of a vertical synchronization signal, a horizontal synchronization signal, and a clock signal in addition to the data enable signal DE, but these signals are not illustrated for convenience of description.

The timing controller 120 may receive the data signal DATA in addition to the data enable signal DE or a driving signal including a vertical synchronization signal, a horizontal synchronization signal, and a clock signal from the image processor 110. The timing controller 120 may output a gate timing control signal GDC for controlling operation timing of the scan driver 140, a data timing control signal DDC for controlling operation timing of the data driver 130, and the like, based on the driving signal.

The data driver 130 may sample and latch the data signal DATA in a digital form supplied from the timing controller 120 in response to the data timing control signal DDC supplied from the timing controller 120, may then convert the sampled and latched signal into a data voltage in an analog form based on a gamma reference voltage, and may output the same. The data driver 130 may output a data voltage through data lines DL1 to DLm. The data driver 130 may be formed in the form of an integrated circuit (IC).

The scan driver 140 may output a scan signal in response to the gate timing control signal GDC supplied from the timing controller 120. The scan driver 140 may output a scan signal including a scan high voltage 과 scan low voltage through gate lines GL1 to GLn. The scan driver 140 may be formed in the form of an integrated circuit (IC) or may be formed on the display panel 150 using a gate in panel method. A scan driver using a gate in panel method will be described below.

The power supply 180 may be connected to a first power line EVDD and a second power line EVSS that are disposed on the display panel 150. The power supply 180 may output a first potential voltage (a high potential voltage) and a second potential voltage (a low potential voltage) through the first power line EVDD and the second power line EVSS. The first potential voltage (the high potential voltage) and the second potential voltage (the low potential voltage) transmitted through the first power line EVDD and the second power line EVSS may be applied to sub-pixels SP of the display panel 150.

The display panel 150 may display an image in response to the voltage supplied from the power supply 180 and the data voltage and the scan signal that are supplied from the data driver 130 and the scan driver 140. The display panel 150 may include the sub-pixels SP operated to display an image. The sub-pixels SP may include one or more different light-emitting areas depending on light-emitting characteristics (the material, lifespan, and luminous intensity of a device, or the like).

As shown in FIG. 2, one sub-pixel SP may be electrically connected to a data line DL1, a gate line GL1, the first power line EVDD, and the second power line EVSS. One sub-pixel SP may include an organic light-emitting diode OLED for emitting light and a pixel circuit CC for driving the organic light-emitting diode OLED.

The pixel circuit CC may include a switching capacitor for transmitting a data voltage, a capacitor for storing the data voltage, a driving transistor for generating driving current based on the data voltage or the like stored in the capacitor. The pixel circuit CC may further include a driving transistor or a compensation circuit for compensation degradation of the organic light-emitting diode OLED or the like.

As shown in FIGS. 3 and 4, the scan driver using a gate in panel method may include a shift register circuit unit 131 (a scan signal generator) and a level shifter 135 (a clock signal and voltage generator). The level shifter 135 may generate and output a plurality of clock signals Gclk, a start signal Gvst, and the like based on the signals output from the timing controller 120.

The shift register circuit unit 131 may be operated based on the plurality of clock signals Gclk, the start signal Gvst, and the like output from the level shifter 135, and may generate and output scan signals Scan[1] to Scan[n] to be output to the display panel 150.

As shown in FIG. 4A, the shift register circuit unit 131 may be disposed in right and left non-display areas NA of the display panel 150. In addition, as shown in FIG. 4B, the shift register circuit unit 131 may also be disposed in upper and lower non-display areas NA of the display panel 150. Although the case in which the shift register circuit unit 131 is arranged in a pair in the non-display areas NA positioned to the right and the left or above and below a display area AA is illustrated, the shift register circuit unit 131 may be disposed in only one of left, right, upper, and lower sides, but the present disclosure is not limited thereto.

Figure 5:
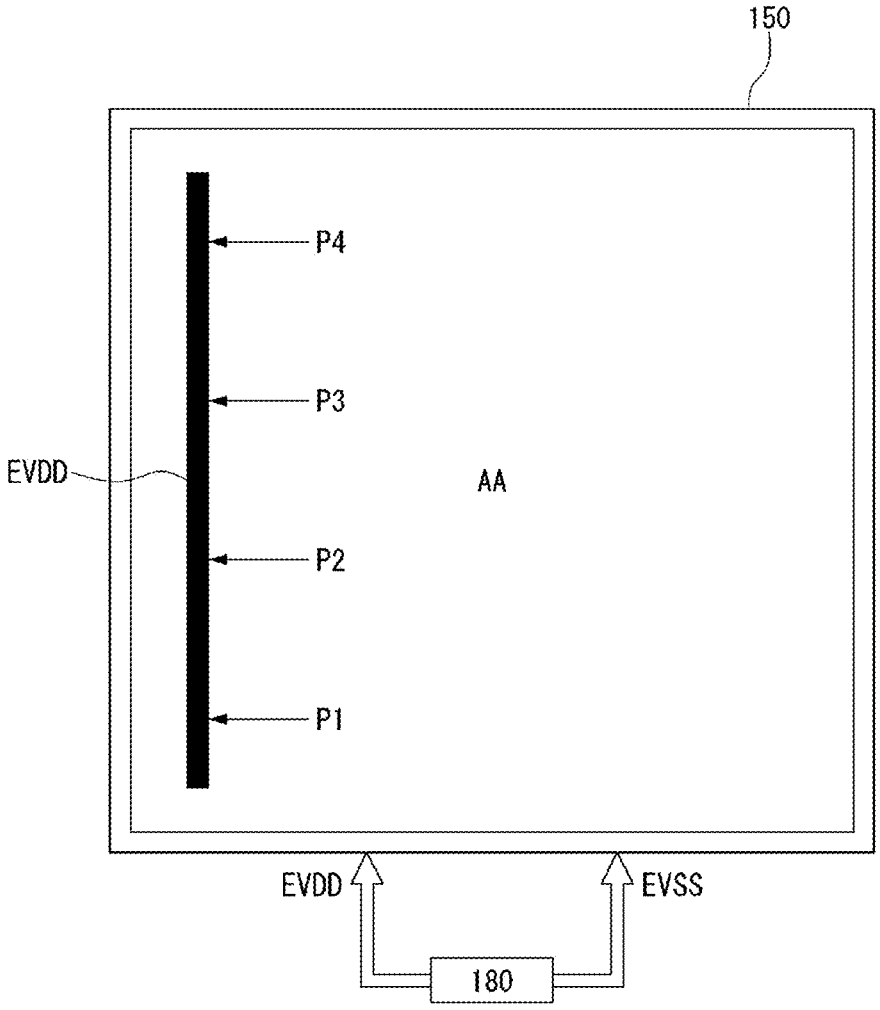
FIGS. 5 and 6 are diagrams for explaining IR drop of a first power line disposed on a display panel.
Figure 6:
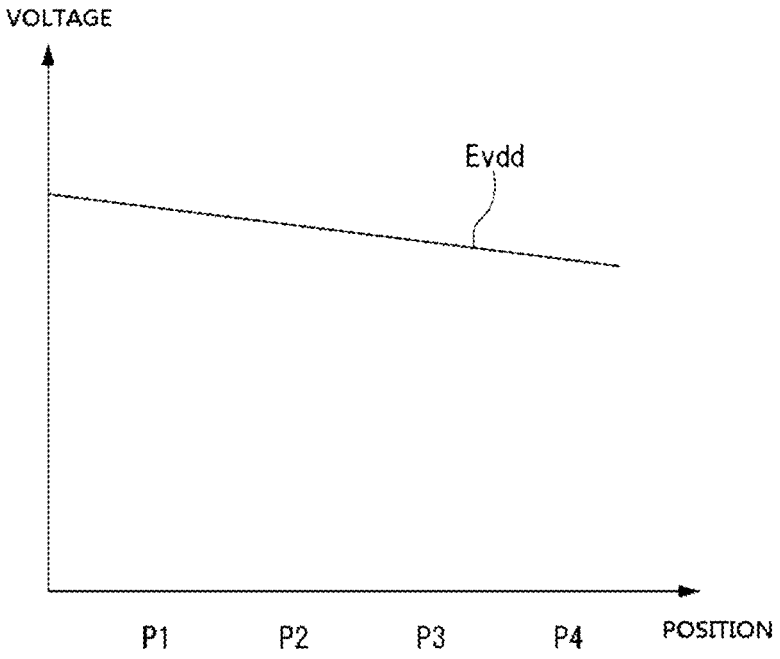

FIGS. 5 and 6 are diagrams for explaining IR drop of a first power line disposed on a display panel.

As shown in FIG. 5, the first power line EVDD and the second power line EVSS may transmit the first potential voltage and the second potential voltage output from the power supply 180 to all sub-pixels of the display panel 150.

The configuration of the first power line EVDD and the second power line EVSS may be changed depending on the configuration of the display panel 150, but the second power line EVSS may be formed in the form of a common layer that covers an entire surface of the display area AA, but the first power line EVDD may be disposed in the form of a solid vertical line as shown in the drawing.

The first power line EVDD may be provided in a plural number or in the form of mesh rather than being provided as one line in the display area AA, but may be affected by IR drop away from an input terminal to which the first potential voltage is input. This may be seen from that a first potential voltage Evdd is lowered to a position P4 from a position P1 in FIG. 6.

Thus, there is a need for a design method in consideration of voltage drop of the first potential voltage applied through the first power line EVDD when a display panel is embodied. Also, there is a need to refer to various design limits as considerations, like in a design limit when a high-resolution display panel is to be embodied, a design limit when a large-area display panel is to be embodied, a design limit when a high-aperture ratio display panel is to be embodied, or a design limit when only a small number of first power lines are arranged due to the characteristics of the structure of a display panel.

Hereinafter, the present disclosure provides a compensation device and a compensation method using the same for exceeding the technological and design limit compared with the prior art in consideration of the aforementioned issue in terms of voltage drop of the first potential voltage in various aspects.

Figure 7:
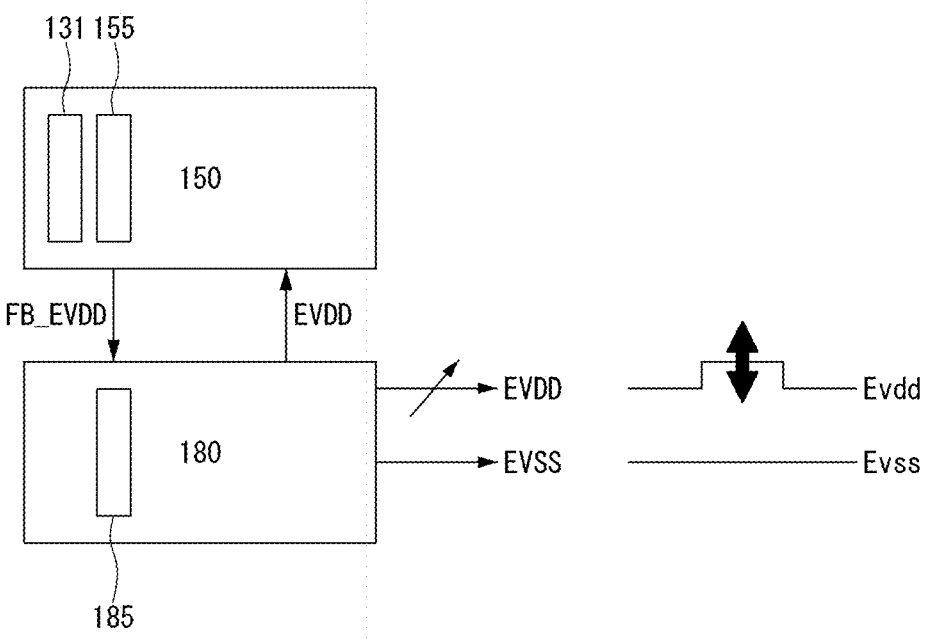
FIG. 7 is a schematic diagram illustrating main components of a light emitting display device according to a first embodiment of the present disclosure.
Figure 8:
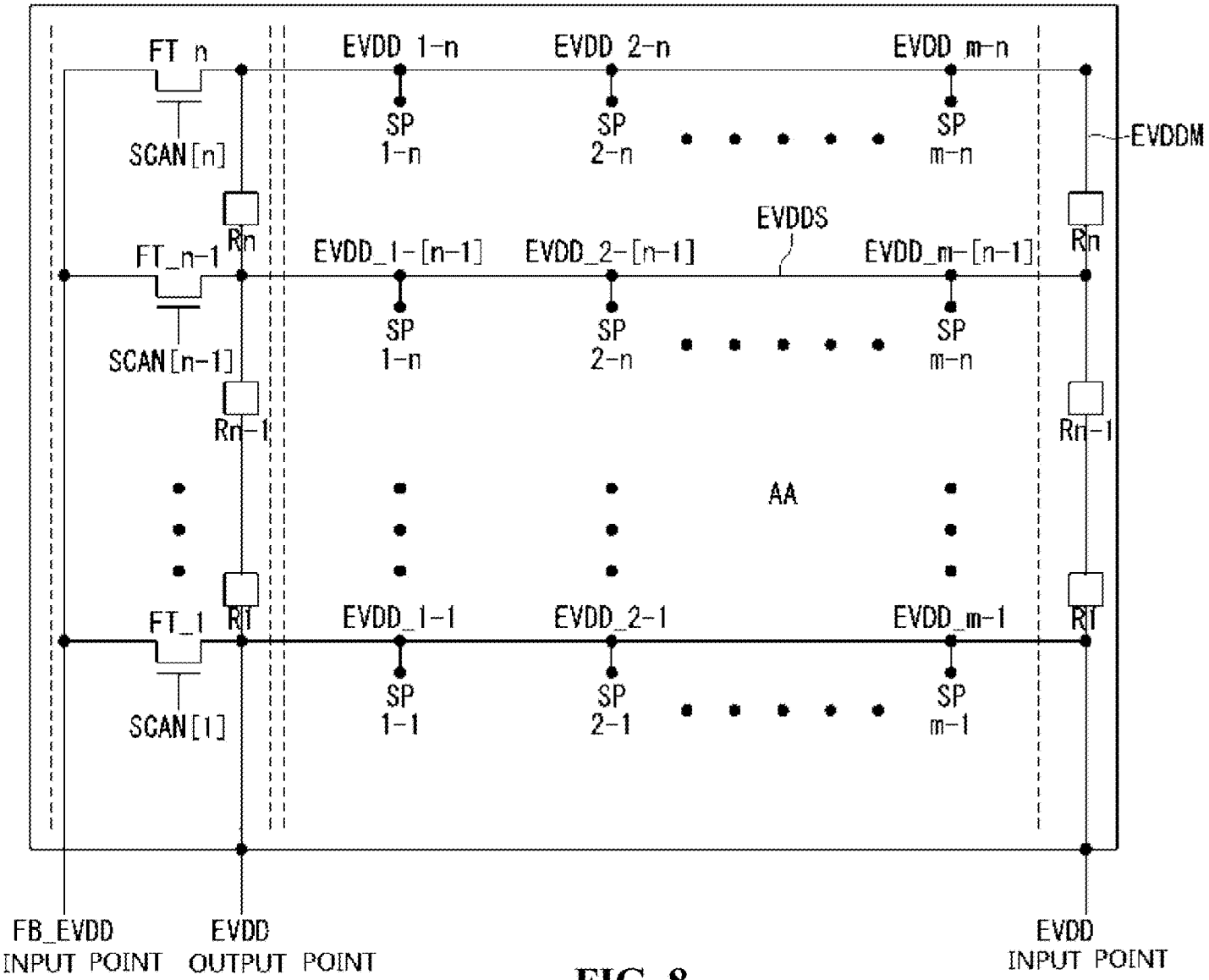
FIG. 8 is a diagram illustrating a switch circuit unit and a pixel circuit unit that are disposed on a display panel in more detail according to the first embodiment of the present disclosure.
Figure 9:
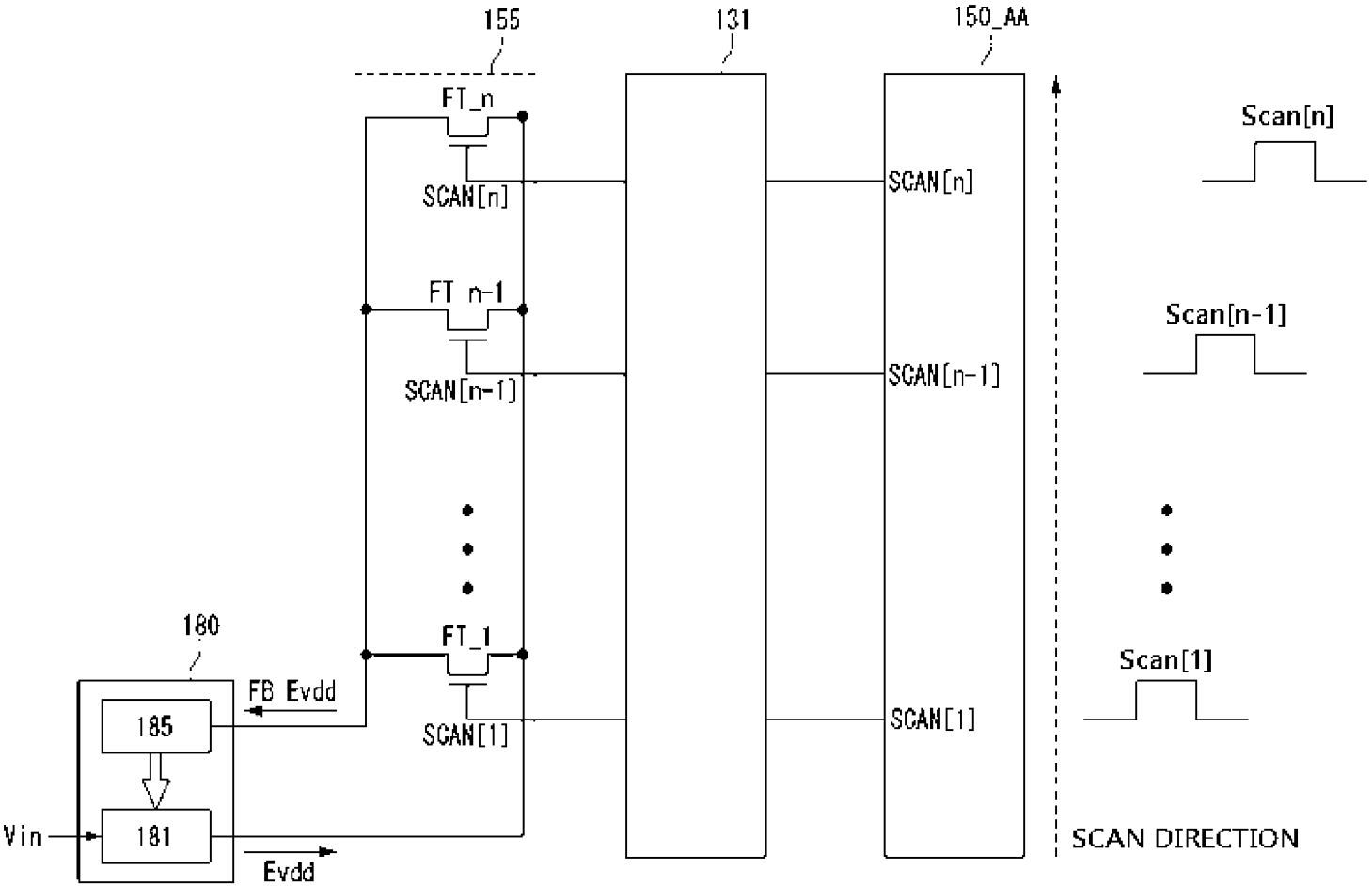
FIG. 9 is a diagram illustrating a first example illustrating a power supply and a switch circuit unit in more detail according to the first embodiment of the present disclosure.
Figure 10:
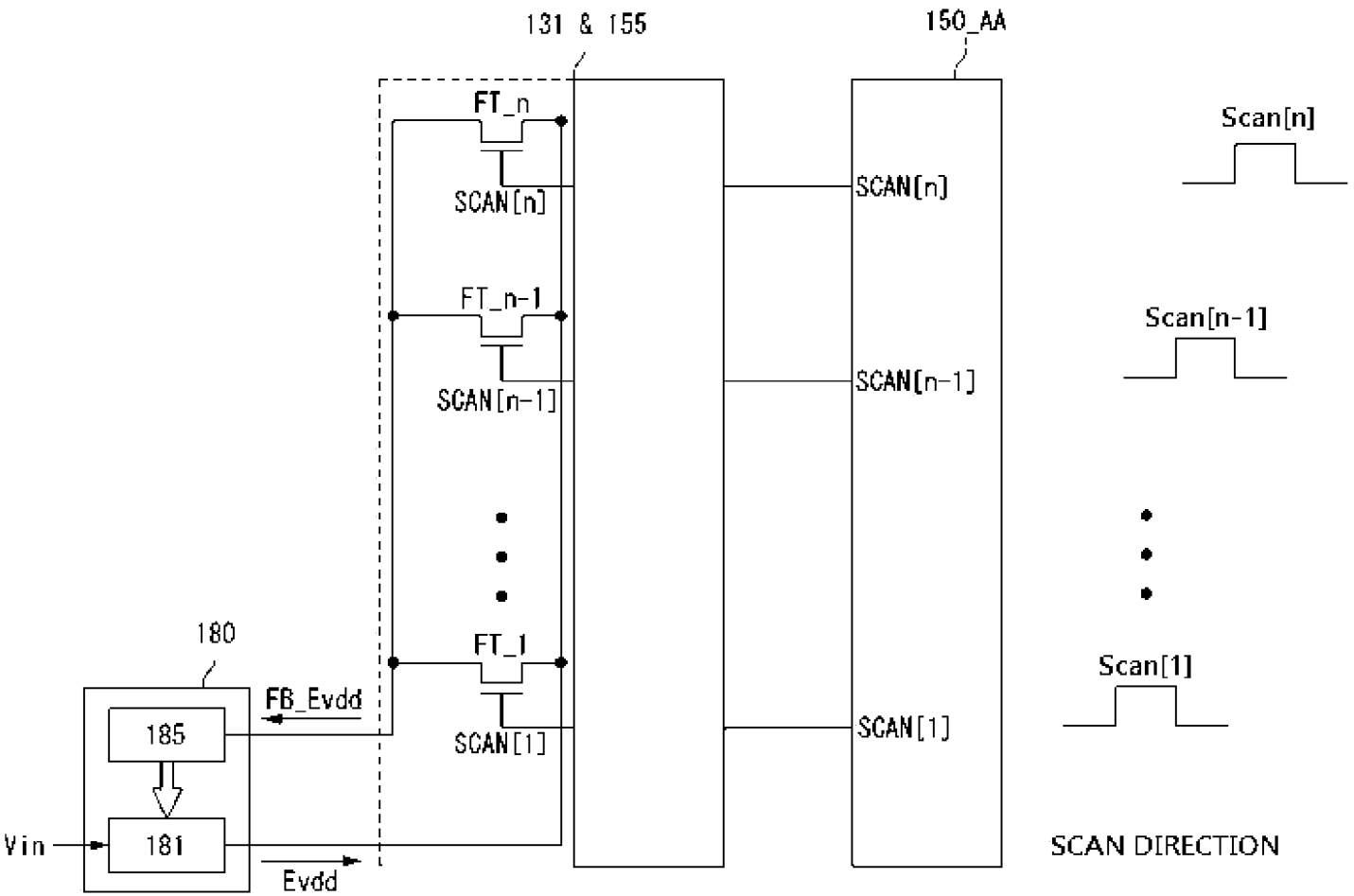
FIG. 10 is a diagram illustrating a second example illustrating a power supply and a switch circuit unit in more detail according to the first embodiment of the present disclosure.

FIG. 7 is a schematic diagram illustrating main components of a light emitting display device according to the first embodiment of the present disclosure, FIG. 8 is a diagram illustrating a switch circuit unit and a pixel circuit unit that are disposed on a display panel according to the first embodiment of the present disclosure in more detail, FIG. 9 is a diagram illustrating a first example of a power supply and a switch circuit unit in more detail according to the first embodiment of the present disclosure, and FIG. 10 is a diagram illustrating a second example of a power supply and a switch circuit unit in more detail according to the first embodiment of the present disclosure.

As shown in FIG. 7, a switch circuit unit 155 may be positioned on the display panel 150. The switch circuit unit 155 may sense the first potential voltage Evdd output from the power supply 180 and may then feedback the same to the power supply 180. To this end, the switch circuit unit 155 may be operatively associated with the shift register circuit unit 131 included in a scan driver.

The power supply 180 may output the first potential voltage Evdd that is compensated based on the first potential voltage fed back by a switching operation of the switch circuit unit 155. To this end, the power supply may have an output end connected to the first power line EVDD of the display panel 150, and an input end (a feedback end) connected to a feedback voltage output end FB_EVDD of the switch circuit unit 155.

According to the aforementioned configuration, the power supply 180 may the issue in terms of IR drop by receiving the first potential voltage fed back from the display panel 150 every specific period and simultaneously outputting the compensated first potential voltage Evdd. In this case, an example in which the power supply 180 varies only the first potential voltage Evdd for compensation in the state in which a second potential voltage Evss is fixed is illustrated. However, depending on a method of driving the display panel 150, the second potential voltage Evss may also be varied in addition to compensation of the first potential voltage Evdd.

As shown in FIG. 8, pixel circuit units SP1-1 to SPm-n may be disposed on the display panel 150. The pixel circuit units SP1-1 to SPm-n may be disposed in a matrix form in the display area AA.

A first main power line EVDDM and a first auxiliary power line EVDDS may be arranged in a mesh form on the display panel 150. The first main power line EVDDM may be disposed in a vertical direction and the first auxiliary power line EVDDS may be disposed in a horizontal direction. The first auxiliary power line EVDDS may be disposed every line like a scan line.

The first main power line EVDDM may have a uniform thickness in a vertical direction, and thus resistance R1<Rn−1<Rn may be increased away from a input point for the first potential voltage. The input point for the first potential voltage may be close to the output end of the power supply.

The switch circuit unit 155 may be disposed in a non-display area adjacent to the display area AA of the display panel 150. The switch circuit unit 155 may include a plurality of switches FT_1 to FT_n. The plurality of switches FT_1 to FT_n may include a 3-electrode device, that is, a transistor.

The switch circuit unit 155 may be operated to sense the first potential voltage applied to sub-pixels every one scan line (when one line is sense, other lines are not sensed). Thus, the plurality of switches FT_1 to FT_n may be arranged one by one every line. There is the probability of current or voltage leakage, and thus in consideration of this, at least two switches may also be disposed every scan line. In addition, the plurality of switches FT_1 to FT_n may also be disposed one by one every at least two scan lines.

However, hereinafter, according to the present disclosure, in order to increase the accuracy/precision of sensing and compensation, one switch may be disposed in one scan line, but the present disclosure is not limited thereto.

As described above, one switch is disposed in one scan line, and thus a first switch FT_1 may be disposed in a first scan line SCAN[1], a $(N-1)^{th}$ switch FT_n−1 may be disposed in a $(N-1)^{th}$ scan line SCAN[n−1], and a $N^{th}$ switch FT_n may be disposed in the last $N^{th}$ scan line SCAN[n].

The plurality of switches FT_1 to FT_n may be sequentially turned on in response to a scan signal (when one line is turned on, other lines are not turned on). To this end, the plurality of switches FT_1 to FT_n may be connected as follows.

The first switch FT_1 may have a gate electrode connected to the first scan line SCAN[1], a first electrode connected to the first main power line EVDDM and the first auxiliary power line EVDDS that are positioned in the first scan line SCAN[1], and a second electrode connected to a feedback voltage output end FB_EVDD. The $(N-1)^{th}$ switch FT_n−1 may have a gate electrode connected to the $(N-1)^{th}$ scan line SCAN[n−1], a first electrode connected to the first main power line EVDDM and the first auxiliary power line EVDDS that are positioned in the $(N-1)^{th}$ scan line SCAN [n−1], and a second electrode connected to the feedback voltage output end FB_EVDD. The $N^{th}$ switch FT_n may have a gate electrode connected to the $N^{th}$ scan line SCAN [n], a first electrode connected to the first main power line EVDDM and the first auxiliary power line EVDDS that are positioned in the $N^{th}$ scan line SCAN[n], and a second electrode connected to the feedback voltage output end FB_EVDD. A second switch to an $(N-2)^{th}$ switch that are positioned between the first switch FT_1 and the $(N-1)^{th}$ switch FT_n−1 may also be connected in the aforementioned form. A input point for a feedback voltage may be close to an input end of the power supply.

In the first example of FIG. 9, the shift register circuit unit 131 may be dispose in a non-display area adjacent to the display area AA of the display panel 150, and the switch circuit unit 155 may be disposed at an outer side compared with the shift register circuit unit 131.

In the second example of FIG. 10, the shift register circuit unit 131 and the switch circuit unit 155 may be integrated into one device and may be arranged in the non-display area adjacent to the display area AA of the display panel 150. In this case, although an example in which the switch circuit unit 155 is disposed at an outer side compared with the shift register circuit unit 131 is illustrated, the arrangement may be opposite.

In the examples of FIGS. 9 and 10, the switch circuit unit 155 is operatively associated with the shift register circuit unit 131 (a gate in panel) disposed in the non-display area of the display panel 150. However, the switch circuit unit 155 may also be operated in response to the scan signal output from the scan driver embodied in the form of an IC, and thus the present examples may be understood as being exemplary. In addition, in the examples of FIGS. 9 and 10, the switch circuit unit 155 is disposed in the non-display area of the display panel 150, but the switch circuit unit 155 may also be disposed inside sub-pixels disposed at the outermost side (which is adjacent to the non-display area) of the display area.

As shown in FIGS. 9 and 10, the plurality of switches FT_1 to FT_n included in the switch circuit unit 155 may be sequentially turned on in response to the scan signal, and thus may be connected to the scan lines SCAN[1] to SCAN[n] of the shift register circuit unit 131, respectively. The switch circuit unit 155 may sequentially turned on every line in response to the scan signals Scan[1] to Scan[n] that are sequentially output from the shift register circuit unit 131.

The power supply 180 may include a first potential voltage output unit 181 for outputting the first potential voltage Evdd, and a power controller 185 for varying the first potential voltage Evdd output from the first potential voltage output unit 181 based on the fed back first potential voltage FB_Evdd.

According to the aforementioned configuration, the switch circuit unit 155 according to a first embodiment may be turned on every scan line, may sense the first potential voltage Evdd, and may feedback the same to the power supply 180. The power supply 180 according to the first embodiment may compensate and output the first potential voltage Evdd based on the fed back first potential voltage FB_Evdd.

Hereinafter, the first potential voltage output unit 181 and the power controller 185 will be described in detail with regard to a second embodiment of the present disclosure.

Figure 11:
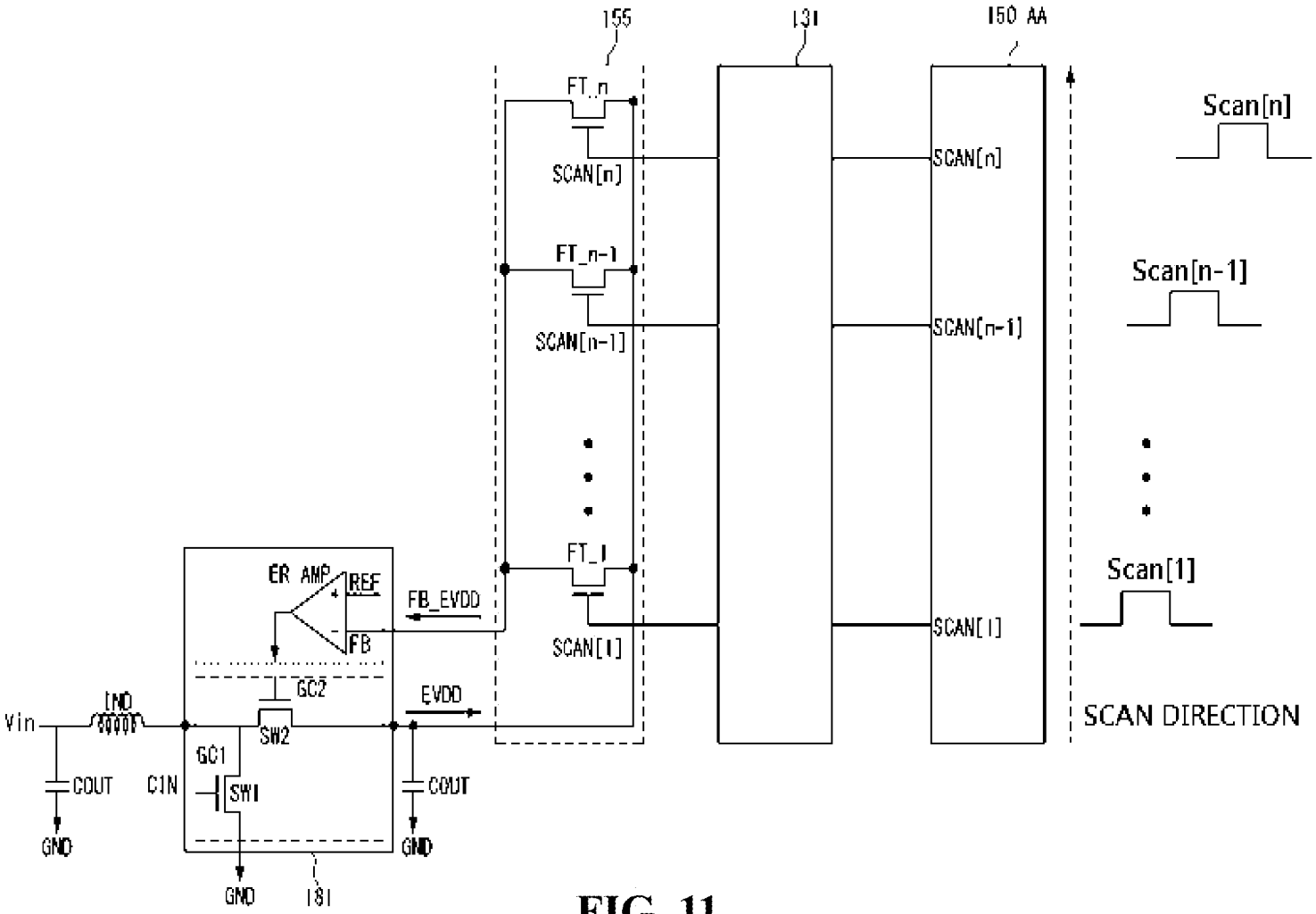
FIG. 11 is a diagram illustrating the configuration of a power supply in more detail according to the second embodiment of the present disclosure.
Figure 12:
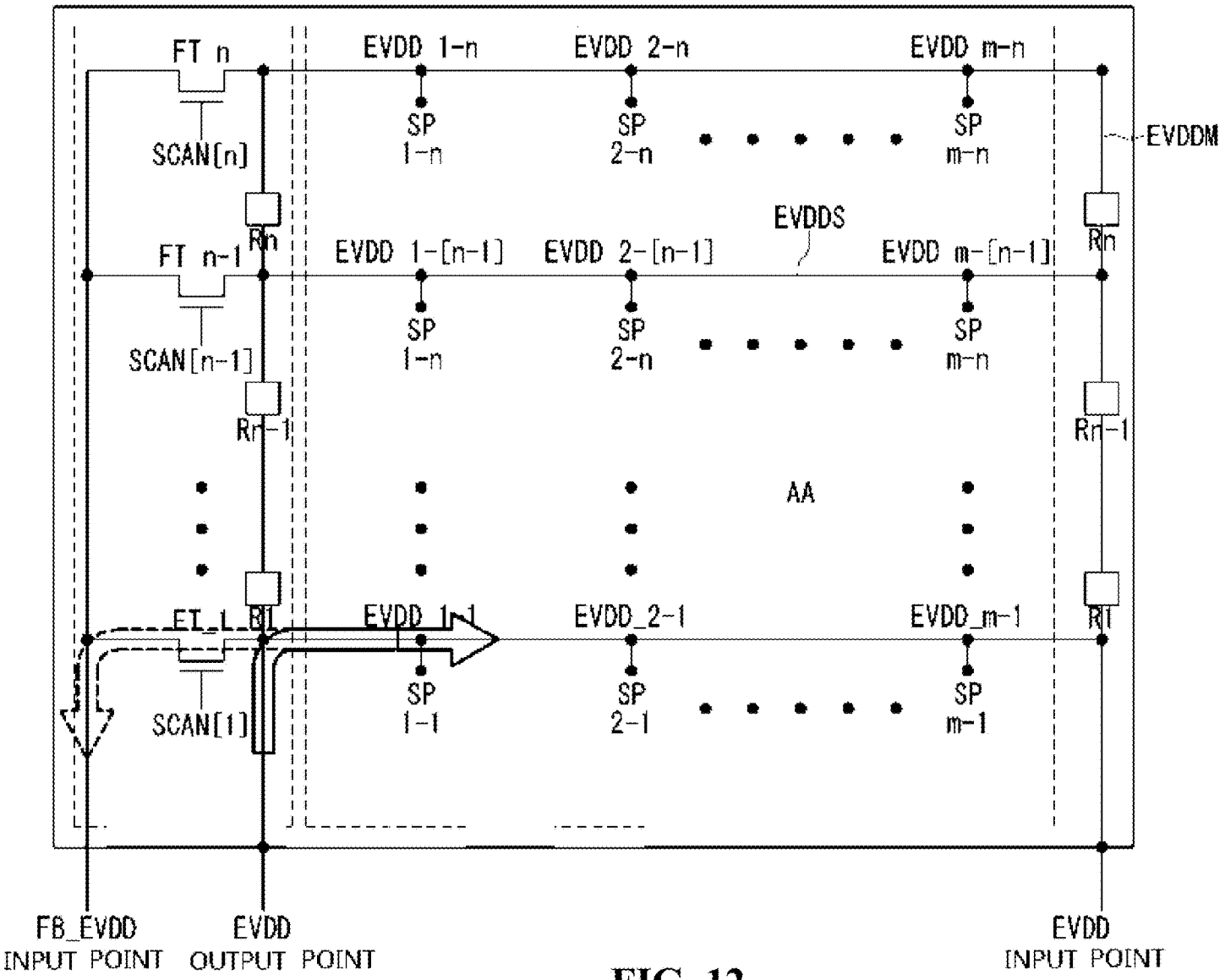
FIGS. 12 to 14 are diagrams illustrating flow of sensing and compensation for each operational state of a switch circuit unit according to the second embodiment of the present disclosure.
Figure 13:
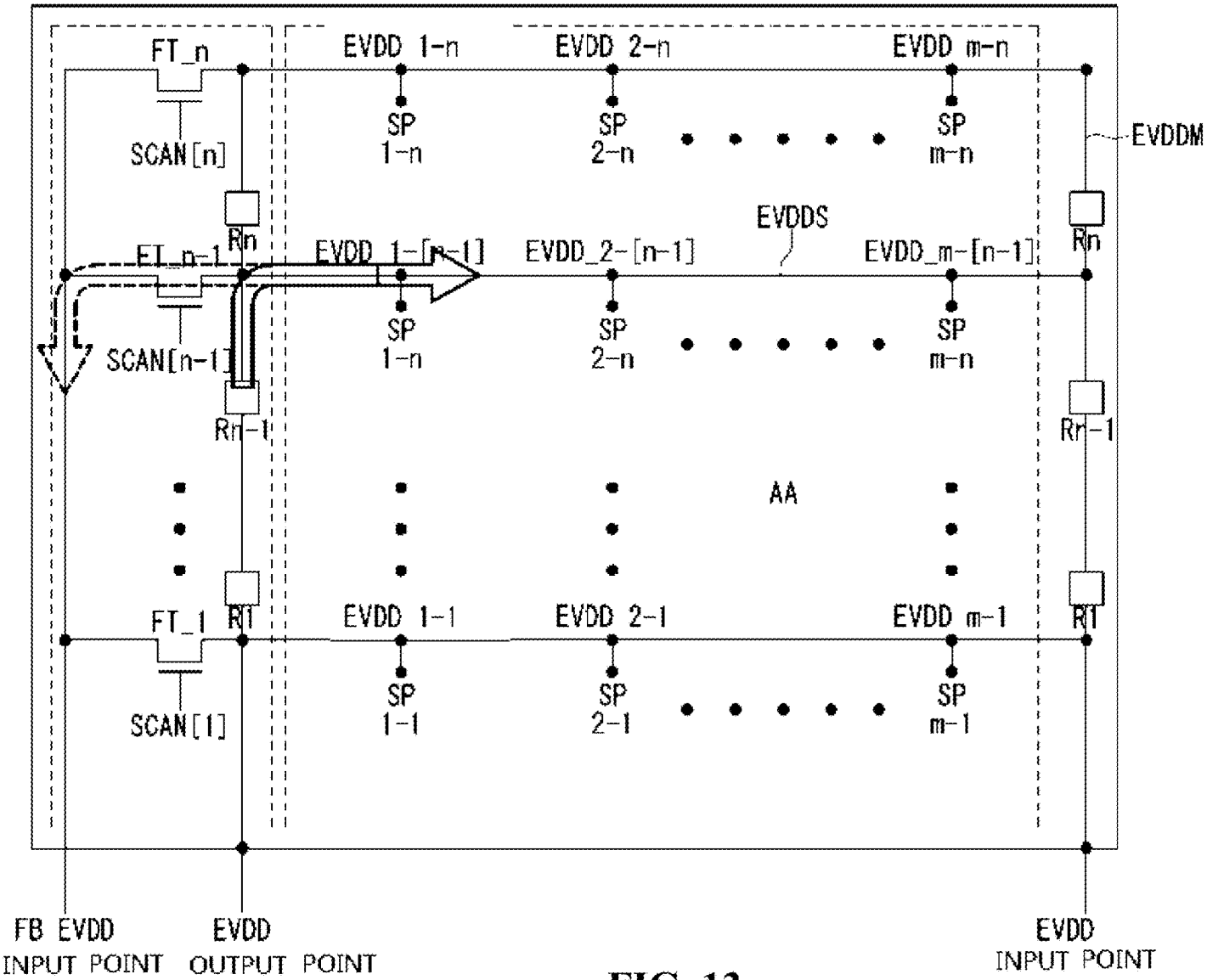
Figure 14:
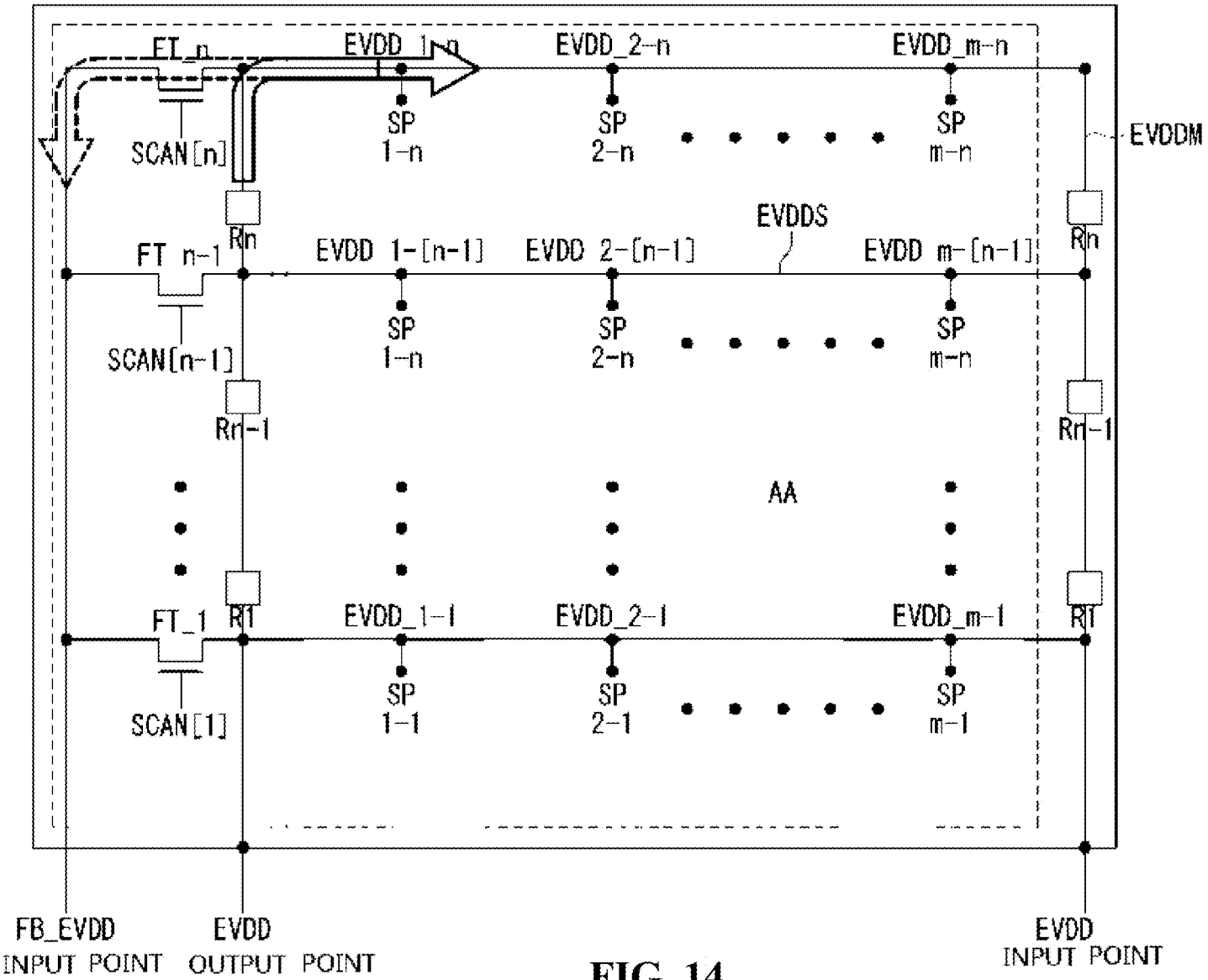
Figure 15:
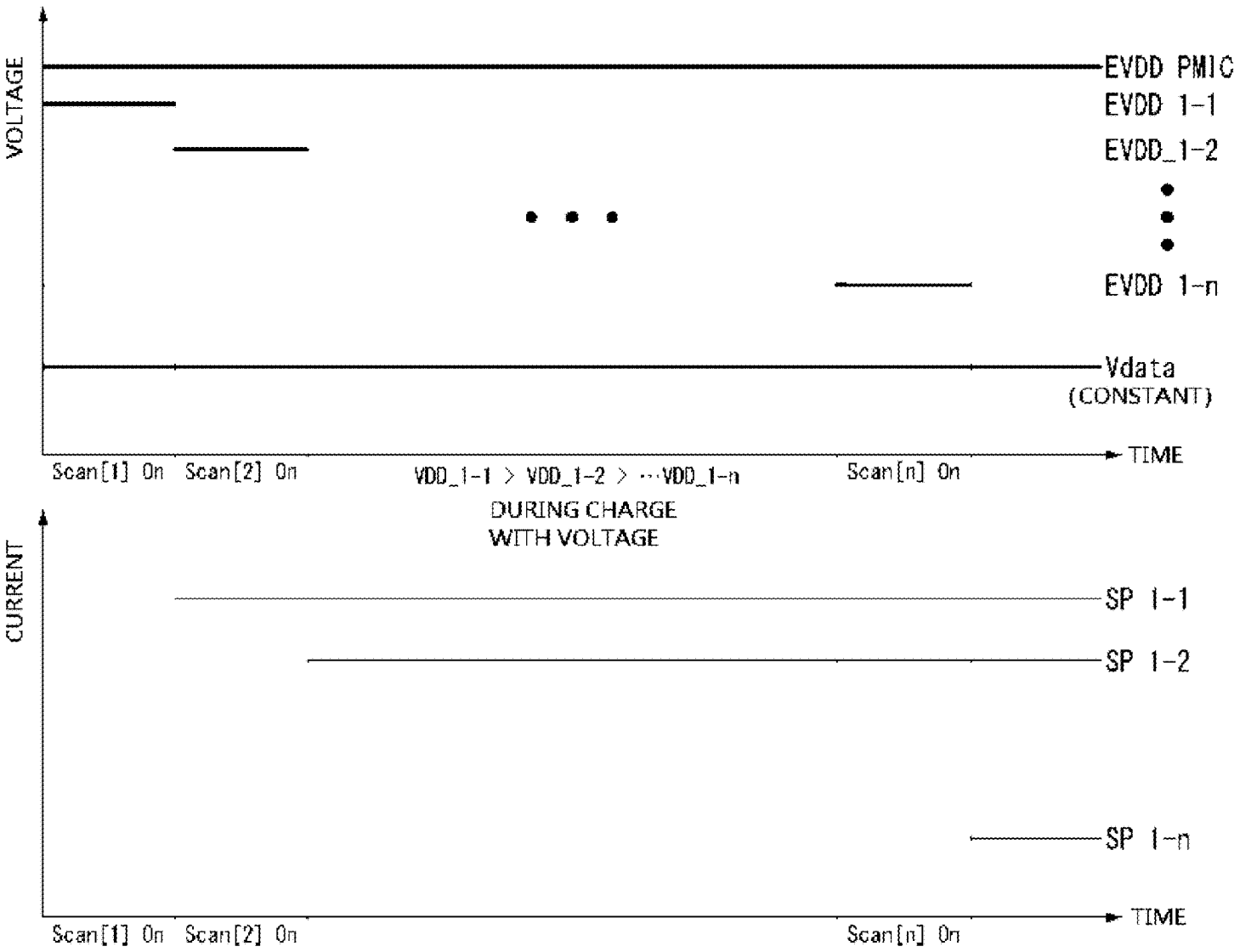
FIGS. 15 and 16 are diagrams showing changes in voltage and current depending on whether a switch circuit unit is operated according to the second embodiment of the present disclosure.
Figure 16:
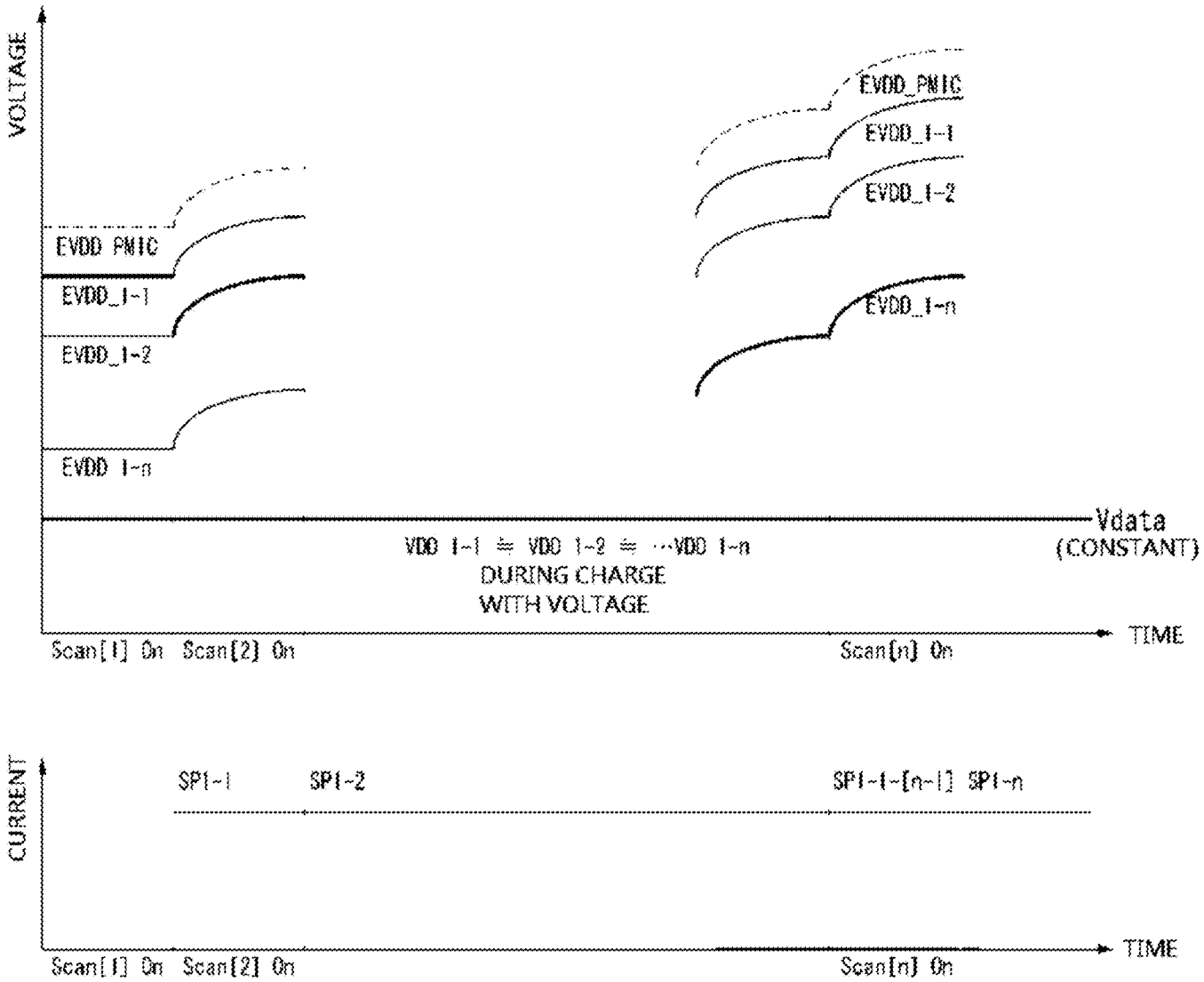

FIG. 11 is a diagram illustrating the configuration of a power supply in more detail according to the second embodiment of the present disclosure, FIGS. 12 to 14 are diagrams illustrating flow of sensing and compensation for each operational state of a switch circuit unit according to the second embodiment of the present disclosure, and FIGS. 15 and 16 are diagrams showing changes in voltage and current depending on whether a switch circuit unit is operated according to the second embodiment of the present disclosure.

As shown in FIG. 11, the first potential voltage output unit 181 may include a passive device such as an input capacitor CIN, an output capacitor COUT, and an inductor IND in addition to an active device such as a first switching transistor SW1 and a second switching transistor SW2.

The input capacitor CIN may have one end connected to an input end VIN and the other end connected to a ground end GND. The inductor IND may have one end connected to one end connected to the input end VIN and the other end connected to a first electrode of the first switching transistor SW1 and a first electrode of the second switching transistor SW2. The output capacitor COUT may have an one end connected to an output terminal EVDDO and the other end connected to the ground end GND.

The first switching transistor SW1 may have a first electrode connected to the other end of the inductor IND, a second electrode connected to the ground end GND, and a gate electrode connected to a first control signal line GC1. The second switching transistor SW2 may have a first electrode connected to the other end of the inductor IND, a second electrode connected to the output terminal EVDDO, and a gate electrode connected to a second control signal line GC2.

The first potential voltage output unit 181 may vary or compensate for an input voltage Vin and may then output the first potential voltage Evdd based on the aforementioned device.

The power controller 185 may include an active device such as an error amplifier ER_AMP. The error amplifier ER_AMP may have a first terminal FB connected to the feedback voltage output end FB_EVDD of the switch circuit unit 155, a second terminal REF connected to a reference voltage, and an output end connected to at least one of the first control signal line GC1 or the second control signal line GC2. Although the drawing illustrates the case in which the power controller 185 includes only one error amplifier ER_AMP, this aids in understanding the present disclosure, the present disclosure is not limited thereto, and the power controller 185 may further include other circuits.

The power controller 185 may output a voltage control signal based on the fed back first potential voltage FB_Evdd, the reference voltage, and the like transmitted from the switch circuit unit 155. The reference voltage may be set to a value for representing a voltage for each scan line over a display panel. The reference voltage may be changed to a representative voltage value for each scan line in synchronization with a scan signal. The voltage control signal may be transmitted through at least one of the first control signal line GC1 or the second control signal line GC2, which is connected to at least one of the first switching transistor SW1 or the second switching transistor SW2 of the first potential voltage output unit 181.

The switch circuit unit 155 embodied using the configuration of FIG. 11 may be turned on in response to a scan signal, may sequentially sense the first potential voltage Evdd every scan line, and may feedback the same to the power supply 180, as shown in FIGS. 12 to 14. Simultaneously, the power supply 180 may compensate for the first potential voltage Evdd every scan line based on the fed back first potential voltage FB_Evdd and may sequentially output the same.

In FIGS. 12 to 14, an arrow descending in a direction toward an output point may refer to sensing and an arrow ascending in an opposite direction to the input point may refer to compensation. According to the present disclosure, as seen from movement of the arrow, the first potential voltage Evdd may be sensed and compensated for every scan line in real time.

As shown in FIG. 15, when a compensation circuit according to the present disclosure is not operated, it may be difficult to prevent a current deviation between sub-pixels SP 1-1 to SP **1-*n*. This is because a first potential voltage EVDD_PMIC of a power supply is constantly output without consideration of IR drop every scan line. Thus, when the compensation circuit is not operated, a current deviation in the sub-pixels SP 1-1 to SP 1-*n* in addition to a deviation VDD_1-1>VDD_1-2> . . . VDD_1-*n* of a first potential voltage in first power lines EVDD_1-1 to EVDD_1-*n*** may be caused every scan line.

As shown in FIG. 16, when a compensation circuit according to the present disclosure is operated, a current deviation in the sub-pixels SP 1-1 to SP **1-*n* may be prevented from being generated. This is because the first potential voltage EVDD_PMIC of the power supply is compensated for and is output in consideration of IR drop every scan line. Thus, when the compensation circuit is operated, compensation VDD_1-1≈VDD_1-2≈ . . . VDD_1-*n* of a first potential voltage every scan line, corresponding to a deviation present in the first power lines EVDD_1-1 to EVDD_1-*n*, is performed, and thus the issue in that a current deviation in the sub-pixels SP 1-1 to SP 1-*n*** is caused every scan line may be overcome.

Referring to FIG. 16, a level of a first potential voltage of an $N^{th}$ scan signal input point Scan[n]) On may be higher than a first potential voltage of a first scan signal input point Scan[1] On close to the power supply. This means that a first potential voltage is compensated for at a high level away from a input point for the first potential voltage. In addition, it may be noted that the simulation results of FIGS. 15 and 16 are obtained by configuring results in the form of graphs in the state in which data voltages Vdata applied to all sub-pixels are maintained constant (e.g., a specific grayscale such as a solid pattern).

Figure 17:
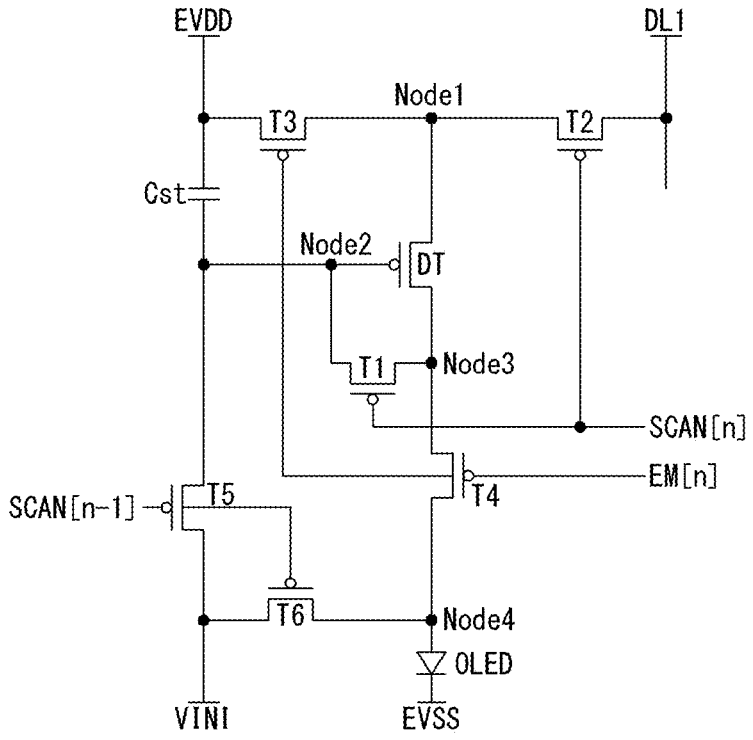
FIG. 17 is a diagram showing an example of the configuration of a circuit of a sub-pixel to which an embodiment of the present disclosure is applicable.

FIG. 17 is a diagram showing an example of the configuration of a circuit of a sub-pixel to which an embodiment of the present disclosure is applicable, and FIGS. 18 to 23 are diagrams for explaining driving timing of the sub-pixel shown in FIG. 17 and advantages when an embodiment of the present disclosure is applied.

As shown in FIG. 17, a sub-pixel to which an embodiment of the present disclosure is applicable may include a circuit for internal compensation. The case in which the sub-pixel of FIG. 17 includes seven P-type transistors T1 to T6 and DT and one capacitor Cst is exemplary, but this is merely exemplary, and the present disclosure may be applied to various internal compensation-type sub-pixels.

The driving transistor DT may have a first electrode connected to a first node Node1, a second electrode connected to a third node Node3, and a gate electrode connected to a second node Node2. The driving transistor DT may generate driving current for operating the organic light-emitting diode OLED.

The first transistor T1 may have a second electrode connected to the second node Node2 as the gate electrode of the driving transistor DT, a first electrode connected to the third node Node3 as a second electrode, and a gate electrode connected to the $N^{th}$ scan line SCAN[n]. The first transistor T1 may make the gate electrode and the second electrode of the driving transistor DT in a diode connection state.

The second transistor T2 may have a first electrode connected to the first data line DL1, a second electrode connected to the first node Node1 as the first electrode of the driving transistor DT, and a gate electrode connected to the $N^{th}$ scan line SCAN[n]. The second transistor T2 may transmit a data voltage input through the first data line DL1 to the first node Node1.

The third transistor T3 may have a first electrode connected to the first power line EVDD, a second electrode connected to the first node Node1, and a gate electrode connected to an $N^{th}$ light emitting control signal line EM[n]. The third transistor T3 may transmit a first potential voltage applied to the first power line EVDD to the first node Node1.

The fourth transistor T4 may have a first electrode connected to the third node Node3, a second electrode connected to a fourth node Node4 connected to an anode of the organic light-emitting diode OLED, and a gate electrode connected to the $N^{th}$ light emitting control signal line EM[n]. The fourth transistor T4 may transmit driving current generated from the driving transistor DT to the organic light-emitting diode OLED.

The fifth transistor T5 may have a first electrode connected to the second node Node2, a second electrode connected to an initialization voltage line VINI, and a gate electrode connected to the $(N-1)^{th}$ scan line SCAN[n−1]. The fifth transistor T5 may transmit an initialization voltage to the second node Node2.

The sixth transistor T6 may have a first electrode connected to the fourth node Node4, a second electrode connected to the initialization voltage line VINI, and a gate electrode connected to the $(N-1)^{th}$ scan line SCAN[n−1]. The sixth transistor T6 may transmit an initialization voltage to the fourth node Node4.

The capacitor Cst may have one end connected to the first power line EVDD and the other end connected to the second node Node2. The capacitor Cst may store data voltage.

The organic light-emitting diode OLED may have an anode connected to the fourth node Node4 and a cathode connected to the second power line EVSS. The organic light-emitting diode OLED may emit light in response to driving current generated from the driving transistor DT.

Figure 18:
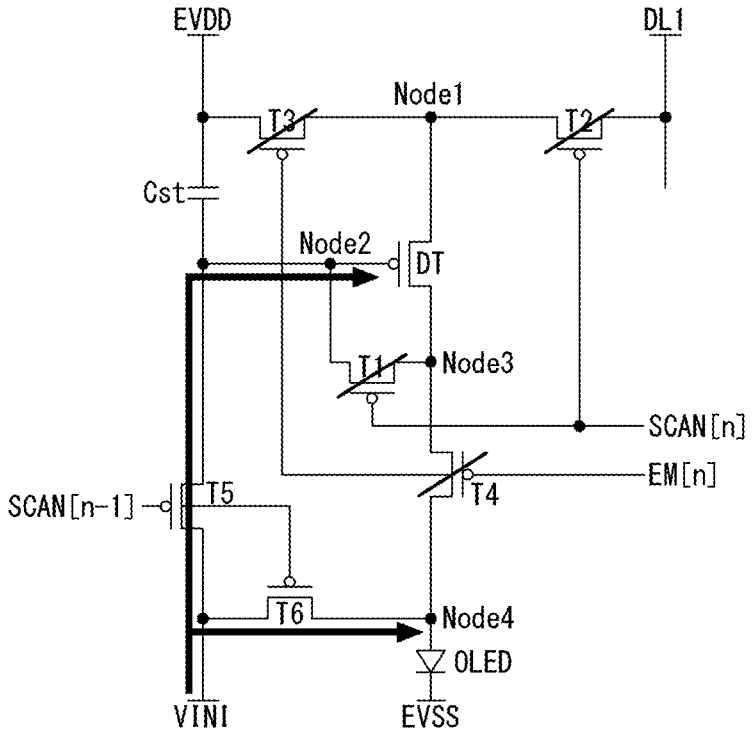
FIGS. 18 to 23 are diagrams for explaining driving timing of the sub-pixel shown in FIG. 17 and advantages when an embodiment of the present disclosure is applied.
Figure 19:
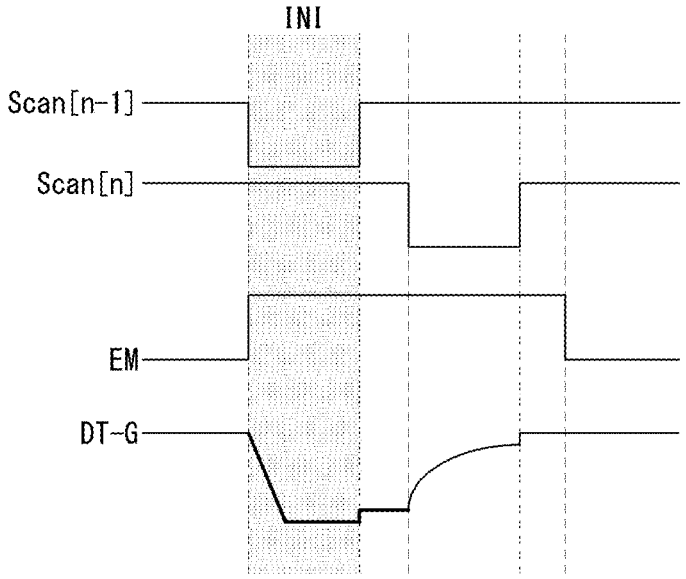

As shown in FIGS. 18 and 19, when the $(N-1)^{th}$ scan line SCAN[n−1] is applied to logic low, the $N^{th}$ scan line SCAN[n] is applied to logic high, and light emitting control signal EM is applied to logic high, a sub-pixel may be initialized. During an initialization procedure INI for initializing a sub-pixel, the fifth transistor T5 and the sixth transistor T6 may be in a turn-on state. In addition, the second node Node2 as a gate node DT-G of the driving transistor DT, the capacitor Cst, and the organic light-emitting diode OLED may be initialized by a low initialization voltage.

Figure 20:
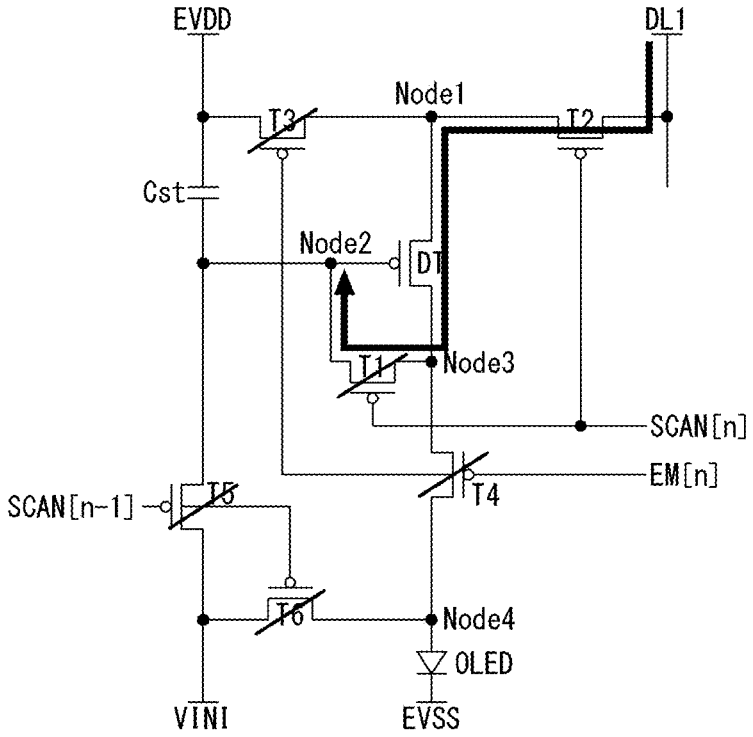
Figure 21:
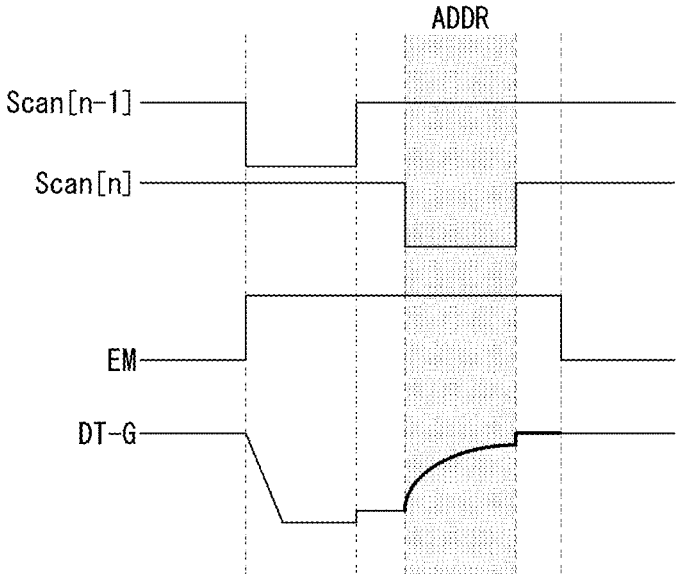

As shown in FIGS. 20 and 21, when the $(N-1)^{th}$ scan line SCAN[n−1] is applied to logic high, the $N^{th}$ scan line SCAN[n] is applied to logic low, and light emitting control signal EM is applied to logic high, a sub-pixel may store a data voltage. During an addressing procedure ADDR for addressing a sub-pixel, the first transistor T1, the second transistor T2, and the driving transistor DT may be in a turn-on state. The capacitor Cst may store a data voltage. In this case, the data voltage may converge to Vdata (data voltage)+Vth (a threshold voltage of DT) (Vth<0 @ PMOS), and opposite ends of the capacitor Cst may be charged with VDD (first potential voltage)−(Vdata+Vth).

Figure 22:
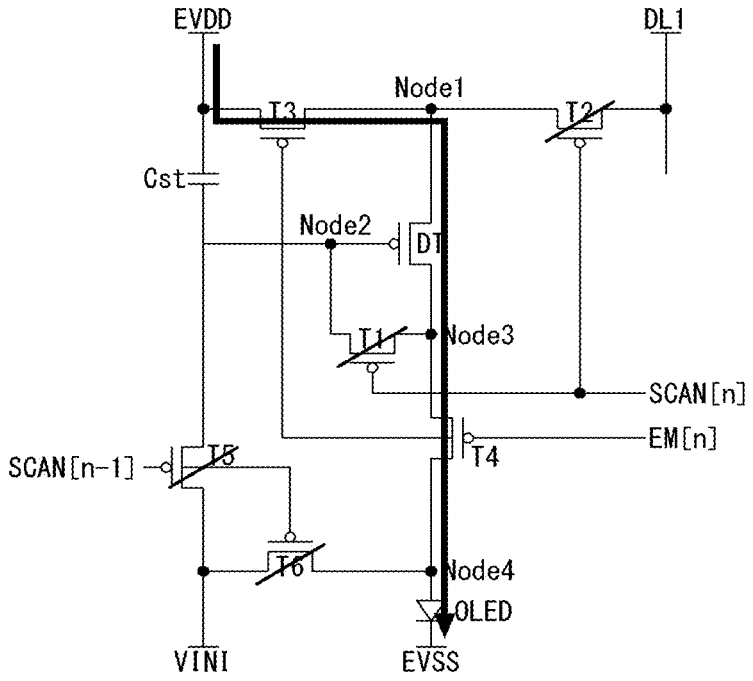
Figure 23:
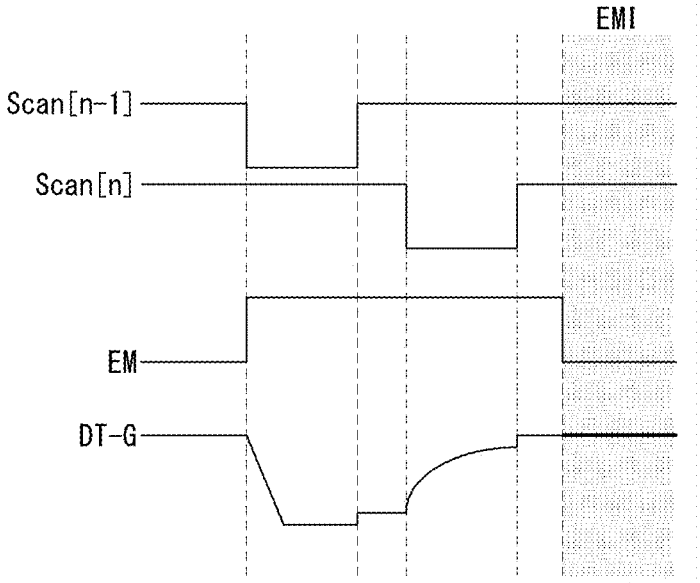

As shown in FIGS. 22 and 23, when the $(N-1)^{th}$ scan line SCAN[n−1]) is applied to logic high, the $N^{th}$ scan line SCAN[n] is applied to logic high, and the light emitting control signal EM is applied to logic low, a sub-pixel may emit light. During a light-emitting procedure EMI for emitting light by the sub-pixel, the third transistor T3, the driving transistor DT, and the fourth transistor T4 may be in a turn-on state. The organic light-emitting diode OLED may emit light.

In this case, driving current of the driving transistor DT may be proportional to $(Vgs-Vth)^2$. In addition, Vgs (a gate source voltage of DT) may correspond to a voltage of opposite ends of the capacitor Cst, and thus in the case of VDD>Vdata, the driving current of the driving transistor DT may be proportional to $(Vgs-Vdata)^2$. Thus, VDD (a first potential voltage) applied during the addressing procedure ADDR for addressing the sub-pixel shown in FIG. 17 may affect brightness. Accordingly, it may be seen that, when the compensation circuit according to the present disclosure is applied to an internal compensation method such as the sub-pixel of FIG. 17, uniformity of brightness of a display panel may be enhanced.

Figure 24:
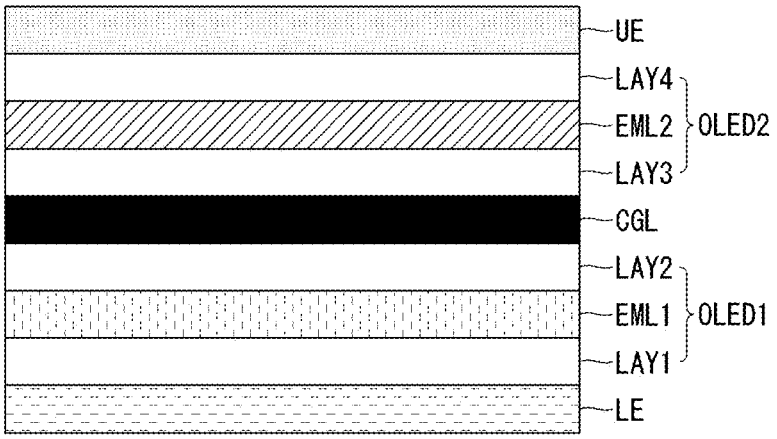
FIGS. 24 and 25 are diagrams illustrating a hierarchical structure for explaining a sub-pixel to which an embodiment of the present disclosure is applicable.
Figure 25:
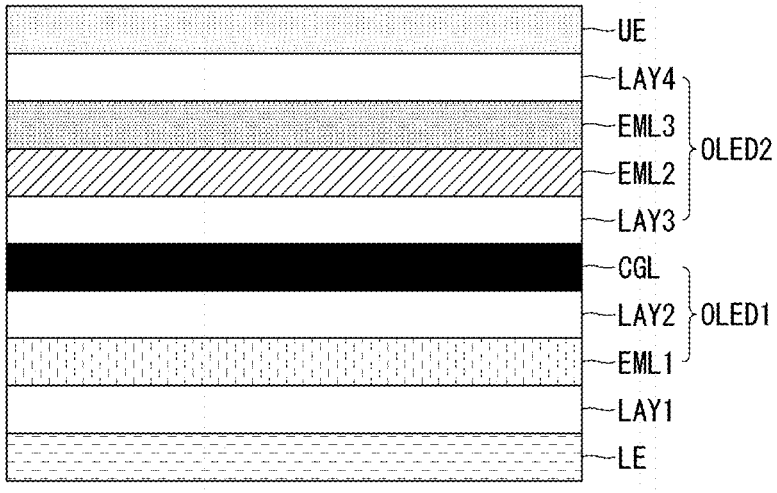

FIGS. 24 and 25 are diagrams illustrating a hierarchical structure for explaining a sub-pixel to which an embodiment of the present disclosure is applicable.

As shown in FIGS. 24 and 25, an organic light-emitting diode may include a lower light-emitting device layer OLED1, a charge-generating layer CGL, and an upper light-emitting device layer OLED2 that are present between a lower electrode layer LE and an upper electrode layer UE.

As shown in FIG. 24, the lower light-emitting device layer OLED1 may include a first light-emitting layer EML1 and a second light-emitting layer EML2 between lower common layers LAY1 and LAY3 and upper common layers LAY2 and LAY4. The first light-emitting layer EML1 and the second light-emitting layer EML2 may respectively emit light with different colors (e.g., selected color among red, green, and blue) in order to emit light with the same color or light with white color, but the present disclosure is not limited thereto.

As shown in FIG. 25, the upper light-emitting device layer OLED2 may include the first light-emitting layer EML1 between the first lower common layer LAY1 and the first upper common layer LAY2, and the second to third light-emitting layers EML2 to EML3 between the second lower common layer LAY3 and the second upper common layer LAY4. The first to third light-emitting layers EML1 to EML3 may respectively emit light with different colors (e.g., selected color among red, green, and blue) in order to emit light with the same color or light with white color, but the present disclosure is not limited thereto.

That is, as shown in FIGS. 24 and 25, an organic light-emitting diode including a light-emitting layer in which at least two layers are stacked may be embodied as a tandem construction for emitting light with one of pure colors such as red, green, and blue and may be included in a sub-pixel or may be embodied as a tandem construction for emitting light with different colors and may be included in a sub-pixel.

Advantages may be provided by applying the present disclosure to a tandem construction in which at least two light-emitting layers OLED1 and OLED2 are present between the lower electrode layer LE (e.g., an anode) and the upper electrode layer UE (e.g., a cathode) of the organic light-emitting diode. One of the reasons will now be described, and this is because, since the organic light-emitting diode embodied as a tandem construction requires a high-driving voltage and has an increased amount of current due to the high-driving voltage, when IR drop of a first potential voltage occurs, influence thereof is intensified.

Accordingly, according to an embodiment of the present disclosure, IR drop of the first potential voltage, which needs to be considered in a sub-pixel including an organic light-emitting diode of a tandem construction, may be sufficiently compensated for, and thus a stress that the device undergoes as well as the driving stability of a device may be relieved, thereby enhancing the lifespan of the device. In addition, according to an embodiment of the present disclosure, IR drop of the first potential voltage may be sufficiently compensated for, thereby achieving uniform brightness.

According to the present disclosure, a deviation in IR drop at the positions of a sub-pixel, which occurs when the size of a display panel is increased in accordance with trends of large display devices, may be prevented and compensated for to achieve uniform brightness. In addition, according to the present disclosure, a deviation in IR drop of a high-brightness and high-current product range may be prevented and compensated for, thereby increasing the lifetime of a device as well as the driving stability of the device.

According to the present disclosure, a deviation in IR drop at the positions of a sub-pixel, which occurs when the size of a display panel is increased in accordance with trends of large display devices, may be prevented and compensated for to achieve uniform brightness. In addition, according to the present disclosure, a deviation in IR drop of a high-brightness and high-current product range may be prevented and compensated for, thereby increasing the lifetime of a device as well as the driving stability of the device.

It will be apparent to those skilled in the art that various modifications and variations can be made in the light emitting display device and the driving method thereof of the present disclosure without departing from the technical idea or scope of the disclosure. Thus, it is intended that the present disclosure cover the modifications and variations of this disclosure provided they come within the scope of the appended claims and their equivalents.

What is claimed is:

1. A light emitting display device, comprising:

a display panel;

a scan driver including a shift register configured to supply a scan signal to the display panel;

a power supply configured to supply a first potential voltage and a second potential voltage to the display panel; and a switch circuit configured to:

sense the first potential voltage applied to the display panel; and feedback the first potential voltage to the power supply, wherein the power supply is further configured to:

compensate for the first potential voltage based on the first potential voltage fed back from the switch circuit; and output a compensated first potential voltage, wherein the switch circuit is electrically connected to the shift register circuit, wherein the switch circuit comprises a plurality of switches positioned in a non-display area of the display panel, and wherein the plurality of switches are configured to be sequentially turned on in response to scan signals that are sequentially output from the shift register circuit.

2. The light emitting display device of claim 1, wherein the switch circuit is further configured to:

sense the first potential voltage applied at least one scan line on the display panel; and feed back the first potential voltage to the power supply.

3. The light emitting display device of claim 1, wherein the power supply is further configured to compensate for the first potential voltage in real time based on the first potential voltage feedback from the switch circuit and a reference voltage.

4. The light emitting display device of claim 1, wherein the first potential voltage is compensated for at a higher level away from a input point for the first potential voltage, disposed on the display panel.

5. The light emitting display device of claim 1, wherein the display panel comprises a light emitting diode comprising a light-emitting layer in which at least two layers are stacked.

6. The light emitting display device of claim 5, wherein the light-emitting layer in which the at least two layers are stacked is configured to:

emit light with a same color to represent a single color; or emit light with different colors to represent white.

7. The light emitting display device of claim 3, wherein the reference voltage is set to a representative value for representing a voltage for each scan line of the display panel.

8. A method of driving a light emitting display device, including a display panel, a scan driver including a shift register configured to supply a scan signal to the display panel, a power supply configured to supply a first potential voltage and a second potential voltage to the display panel, and a switch circuit configured to sense the first potential voltage applied to the display panel, the switch circuit being electrically connected to the shift register circuit, the switch circuit comprising a plurality of switches positioned in a non-display area of the display panel, the method comprising:

sensing the first potential voltage applied to the display panel;

feeding back the first potential voltage to the power supply; and compensating for the first potential voltage to be applied to the display panel based on the fed back first potential voltage, wherein the plurality of switches are sequentially turned on in response to scan signals that are sequentially output from the shift register circuit.

9. The method of claim 8, wherein the compensating for the first potential voltage to be applied to the display panel comprises compensating for the first potential voltage in real time based on the fed back first potential voltage and a reference voltage.

10. The method of claim 8, wherein the first potential voltage is compensated for at a higher level away from a input point for the first potential voltage, disposed on the display panel.

11. The method of claim 8, wherein the sensing the first potential voltage comprises sensing the first potential voltage applied at least one scan line on the display panel.

12. The method of claim 9, wherein the reference voltage is set to a representative value for representing a voltage for each scan line of the display panel.

13. The light emitting display device of claim 1, wherein:

the shift register circuit and the switch circuit are integrated into one device; and the shift register circuit and the switch circuit are disposed in the non-display area of the display panel.

* * * * *